US009749753B2

(12) United States Patent
Petersen et al.

(10) Patent No.: US 9,749,753 B2
(45) Date of Patent: Aug. 29, 2017

(54) HEARING DEVICE WITH LOW-ENERGY WARNING

(71) Applicant: OTICON A/S, Smørum (DK)

(72) Inventors: Morten Kjær Petersen, Smørum (DK); Mikael Andersen, Smørum (DK)

(73) Assignee: OTICON A/S, Smørum (DK)

( * ) Notice: Subject to any disclaimer, the term of this patent is extended or adjusted under 35 U.S.C. 154(b) by 64 days.

(21) Appl. No.: 14/619,889

(22) Filed: Feb. 11, 2015

(65) Prior Publication Data

US 2015/0230032 A1 Aug. 13, 2015

(30) Foreign Application Priority Data

Feb. 12, 2014 (EP) ..... 14154840

(51) Int. Cl.
*H04R 25/00* (2006.01)

(52) U.S. Cl.
CPC ..... *H04R 25/30* (2013.01); *H04R 25/305* (2013.01); *H04R 25/558* (2013.01); *H04R 2225/33* (2013.01)

(58) Field of Classification Search
CPC .. H04R 25/30; H04R 25/305; H04R 2225/55; A61N 1/37247

(Continued)

(56) References Cited

U.S. PATENT DOCUMENTS 5,173,855 A * 12/1992 Nielsen ..... A01G 25/16 239/69

6,310,556 B1 * 10/2001 Green ..... G08B 21/185 340/539.1

(Continued)

FOREIGN PATENT DOCUMENTS

EP 1 628 504 A2 2/2006
EP 1 717 662 A1 11/2006

(Continued)

*Primary Examiner* — Alexander Jamal
(74) *Attorney, Agent, or Firm* — Birch, Stewart, Kolasch & Birch, LLP

(57) ABSTRACT

The present invention regards a hearing device comprising a power source, a control unit, a power source charge state monitoring unit, a timing unit, and an output unit. The hearing device is configured to be worn on or at an ear of a user. The power source is configured to power the hearing device. The power source charge state monitoring unit is configured to monitor the charge state of the power source by determining a current output voltage value of the power source. The timing unit is configured to measure a duration between two points in time. The output unit is configured to generate output sounds corresponding to electrical sound signals. The control unit is configured to activate a low-energy warning mode, if the current output voltage value determined by the power source charge state monitoring unit is below a predetermined threshold output voltage value of the power source. The control unit is further configured to adjust the predetermined threshold output voltage value in dependence of a duration of the low-energy warning mode. The control unit operating in the low-energy warning mode is configured to generate electrical low-energy warning signals. The output unit is configured to generate output stimuli perceived by the user as sounds corresponding to the electrical low-energy warning signals and/or to transmit such output sounds and/or signals indicating low energy warning signals to another device.

15 Claims, 4 Drawing Sheets

(58) Field of Classification Search
USPC ..... 381/323, 60, 314
See application file for complete search history.

(56) References Cited

U.S. PATENT DOCUMENTS

| | | | | |
|---|---|---|---|---|
| 6,320,969 | B1 | 11/2001 | Killion | |
| 2003/0006651 | A1* | 1/2003 | Ballantyne | H02J 7/0065 307/85 |
| 2006/0017581 | A1 | 1/2006 | Schwendinger et al. | |
| 2006/0023907 | A1 | 2/2006 | Kasztelan | |
| 2015/0149169 | A1* | 5/2015 | Chang | G10L 15/26 704/235 |

FOREIGN PATENT DOCUMENTS

| | | | |
|---|---|---|---|
| WO | WO 2007/042026 | A1 | 4/2007 |
| WO | WO 2013/107507 | A1 | 7/2013 |

* cited by examiner

HEARING DEVICE WITH LOW-ENERGY WARNING

The invention refers to a hearing device comprising a power source, a control unit, a power source charge state monitoring unit, a timing unit, and an output transducer and which is configured to generate low-energy warning signals specific to a user and a method to generate low-energy warning signals specific to a user.

Hearing devices, such as headphones, ear-phones, headsets, telephones, hearing aid devices, or the like are used for stimulating the hearing of a user. Typically, a hearing device therefore generates output sounds and provides the output sounds to an ear of a user.

Hearing aid devices are for instance used to assist the hearing of a user by sound generated by a speaker, by bone conducted vibrations generated by a vibrator of a bone anchored hearing aid, or by electric stimulation impulses generated by electrodes of a cochlear implant. Hearing aids can be worn on one ear, i.e. monaurally, or on both ears, i.e. binaurally. A binaural hearing aid system comprises two hearing aid devices, one for a left ear and one for a right ear of the user. The hearing aid devices of a binaural hearing aid system can exchange information with each other wirelessly and allow spatial hearing.

Hearing devices (e.g. hearing aid devices) typically comprise an input unit, e.g. a microphone, an output unit, e.g. an output transducer, e.g. speaker or vibrator, electric circuitry, and a power source. The microphone receives a sound from the environment and generates an electrical sound signal representing the sound. Alternatively (or additionally), the input unit may comprise a transceiver (e.g. a wireless receiver) for receiving an electric signal representing a sound signal (thereby providing an electric sound signal). The electrical sound signal is processed, e.g., frequency selectively amplified, noise reduced, adjusted to a listening environment, and/or frequency transposed or the like, by the electric circuitry and a processed sound is generated by the output transducer to stimulate the hearing of the user. Instead of an output transducer, an output unit of a cochlear implant typically comprises an array of electrodes, which are arranged in a cochlea of an ear of the user to stimulate cochlear nerve fibres with electric stimulation impulses. In order to improve the hearing experience of the user a spectral filterbank can be included in the electric circuitry, which, e.g., analyses different frequency bands or processes electrical sound signals in different frequency bands individually and allows improving the signal-to-noise ratio.

For certain acoustical environments a microphone to record direct sound can be insufficient to generate a suitable hearing experience for the hearing aid device user, e.g., in a highly reverberant room like a church, a lecture hall, a concert hall or the like. Therefore hearing aid devices can include a second input for sound information, e.g., a telecoil or a wireless data receiver, such as a Bluetooth receiver, an FM receiver, or an infrared receiver, or the like. When using telecoil or other wireless technology an undistorted target sound, e.g., a priest's voice in a church, a lecturer's voice in a lecture hall, or the like is available directly in the hearing aid by wireless sound transmission.

One way to characterize hearing aid devices is by the way they are fitted to an ear of the user. Conventional hearing aids include for example ITE (In-The-Ear), ITC (In-The-Canal), CIC (Completely-In-the-Canal) and BTE (Behind-The-Ear) hearing aids. The components of the ITE hearing aids are mainly located in or at an ear, while ITC and CIC hearing aid components are located in an ear canal. BTE hearing aids typically comprise a Behind-The-Ear unit, which is generally mounted behind or on an ear of the user and which may be connected to an air filled tube or a lead (comprising conducting wire(s)) that has a distal end that can be fitted in an ear canal of the user. Sound generated by a speaker located in the BTE-unit can be transmitted through the air filled tube to an ear drum of the user's ear canal, or an electrical sound signal can be transmitted from the BTE unit to an output transducer arranged in the ear canal via the lead.

Hearing aid devices typically use batteries, accumulators or rechargeable battery packs as power source. The energy of the power source depletes over time by using the hearing aid device. During the depletion of the power source typically the output voltage of the power source decreases due to an increase of internal resistance in the power source. The power source of a hearing aid device often has to be replaced after a few days or for some hearing aid devices after a little bit more than a week with a new or recharged power source. In order for a user of the hearing aid device to know when the power source is low in energy, hearing aid devices typically comprise a low-energy warning sound when a low-energy threshold, i.e., a low-energy output voltage, is reached. The hearing aid devices can be operated for a certain amount of time after the low-energy warning sound is emitted by the hearing aid device and before operation is stopped because of too low energy supply. Therefore typically it is desirable to start a low-energy warning at a time that allows the user to replace the power source before the battery dies, leading to loss of hearing ability for the user.

U.S. Pat. No. 6,320,969 B1 presents a hearing aid with a hearing aid circuit, a battery, and an alarm system. The hearing aid circuit includes an amplifier for amplifying audio signals. The battery is connected to supply power to the hearing aid circuit. The alarm system generates an audio signal in an audible frequency range in response to the voltage output of the battery falling below a predetermined threshold value. The audio signal is connected for amplification by the amplifier. The audio signal comprises a cyclically alternating uninterrupted audio signal and is an audible frequency tone having at least one of a frequency and a loudness that increases as the voltage of the battery decreases. The sound pressure level of the audio signal doubles for each 20 mV decrease in battery voltage below the predetermined threshold value. The hearing aid can comprise means to disable the alarm system to inhibit generation of the audio signal.

EP 1 628 504 A2 shows a hearing aid with a power saving mode and a method to use the hearing aid in the power saving mode. The hearing aid comprises an input transducer, a signal processing unit, an output transducer, a voltage source, means for testing a charge state of the voltage source, and means for suppressing low frequency signal parts of an acoustic output signal. The input transducer receives an acoustic input signal and generates an electrical signal. The electrical signal is processed in the signal processing unit and provided to the output transducer. The output transducer is configured to emit an acoustic output signal generated from the processed electrical signal. The means for testing a charge state of the voltage source are configured to determine a charge state of the voltage source. The means for suppressing low frequency signal parts of the acoustic output signal are configured to suppress low frequency signal parts in dependence of the charge state of the voltage source. The hearing aid can comprise one or more threshold values of the output voltage of the voltage source which lead to a suppression of different low frequency signal parts. The hearing aid can emit a warning signal to the user to indicate the discharging of the voltage source.

It is an object of the invention to provide an improved hearing device.

This object is achieved by a hearing aid device comprising a power source, a control unit, a power source charge state monitoring unit, a timing unit, and an output unit, e.g. an output transducer. The power source is configured to power the hearing device. The power source charge state monitoring unit is configured to monitor the charge state of the power source by determining a current output voltage value of the power source. The timing unit is configured to measure a duration between two points in time. The output unit may comprise an output transducer configured to generate output sounds corresponding to electrical sound signals. In an embodiment, the output unit comprises a transmitter for transmitting signals representative of output sounds (e.g. coded signals) and/or signals indicating low energy warning signals to another device (e.g. to be presented at another (e.g. an auxiliary) device, e.g. to alert a parent or other caretaker). The control unit is configured to activate a low-energy warning mode, if the current output voltage value determined by the power source charge state monitoring unit is below a predetermined threshold output voltage value of the power source. The control unit is further configured to adjust the predetermined threshold output voltage value in dependence of a duration of the low-energy warning mode. The control unit operating in the low-energy warning mode is configured to generate electrical low-energy warning signals. The output unit, e.g. an output transducer, is configured to generate output sounds (in the sense stimuli that is perceived as output sounds) corresponding to the electrical low-energy warning signals.

In an embodiment, the low-energy warning mode is performed until the power source runs out of energy or the power source is replaced leading to a current output voltage value above the predetermined threshold output voltage value. The low-energy warning mode can also run until a current output voltage value below a predetermined final warning threshold output voltage value is reached. The duration of the low-energy warning mode can be determined between the point in time, when the low-energy warning mode is activated and one of the points in time of a) power source energy running out, b) replacement of power source or c) current output voltage value crossing the predetermined final warning threshold output voltage value. In an embodiment, the duration of the low-energy warning mode can be determined only for the duration as long as the hearing device runs, meaning that times when the hearing device is turned off are not added to the duration of the low-energy warning mode.

The power source charge state monitoring unit can be a unit of the hearing device or an algorithm performed by the control unit of the hearing device. The timing unit can also be a unit of the hearing device or an algorithm performed by the control unit of the hearing device. In an embodiment, the control unit form part of a separate remote control unit, or is implemented as an APP in a SmartPhone.

One aspect of the invention is that the low-energy warning mode and its duration can be adjusted to fit the user and/or usage needs. Another aspect of the invention is that the duration of the low-energy warning mode can be adjusted to a defined duration, e.g., between 2 to 4 hours. Further the invention can be easily implemented in prior art low-energy warning systems, e.g., in hearing aids that provide a low-energy warning mode starting below a certain output voltage, e.g., 1.15 V, and which provides a low-energy warning every 15 minutes until the current output voltage reaches a final warning output voltage, e.g., 1.1 V. The duration of the low-energy warning mode adjusted to fit the user prevents users to experience excessively long warning durations, e.g., 4 days and too short warning durations, e.g., a few minutes. Further, the exactness of the prediction of the remaining time until the battery runs out of energy is increased, allowing to use batteries for a longer duration and to a lower charge state.

In one embodiment, the control unit is configured to (automatically) increase the predetermined (low energy) threshold output voltage value if the duration of the low-energy warning mode is below a predetermined short warning duration. The control unit can also be configured to decrease the predetermined threshold output voltage value if the duration of the low-energy warning mode is above a predetermined long warning duration. The predetermined threshold output voltage value can be increased or decreased continuously, by adaptive steps, or by fixed steps, e.g., with step sizes of 0.001 V, 0.002 V, 0.005 V, 0.01 V, 0.02 V, or 0.05 V. In practice, a relevant predetermined threshold output voltage value is dependent on the specific battery technology and/or the IC-technology, the power consumption, the battery capacity, etc. In an embodiment, the predetermined threshold output voltage value is equal to or above 0.95 V, e.g. equal to or above 1.05 V, such as equal to or above 1.10 V, such as equal to or above 1.125 V, such as equal to or above 1.15 V. In an embodiment, the predetermined threshold output voltage value is in the range between 0.95 V and 1.15 V.

The predetermined short warning duration can have a smaller duration than the predetermined long warning duration. Typically, the short warning duration is smaller than the long warning duration, but the two can take on any value appropriate for (or determined by) the practical application. The predetermined short warning duration can be equal to or below 120 minutes, such as equal to or below 60 minutes, such as equal to or below 30 minutes. The predetermined long warning duration can be equal to or above 2 h, such as equal to or above 4 h, such as equal to or above 8.5 h. The predetermined short warning duration and predetermined long warning duration can be adjustable, e.g., by the user of the hearing device. The predetermined short warning duration and/or predetermined long warning duration can be increased or decreased continuously, by adaptive steps, or by fixed steps, e.g., with step sizes of 1 minute, 10 minutes, 30 minutes, 1 h, 2 h, or 4 h.

The control unit can be configured to generate an electrical final warning signal, if the current output voltage value determined by the power source charge state monitoring unit is below a predetermined final warning threshold output voltage value. The control unit can be configured to deactivate the low-energy warning mode when the current output voltage value is below the final warning threshold output voltage value. The electrical final warning signal can be different from the electrical low-energy warning signal in order to allow the differentiation between the electrical low-energy warning signals and the electrical final warning signal. In an embodiment, the predetermined final warning threshold output voltage value is fixed. Alternatively, the predetermined final warning threshold output voltage value can also be adjustable, i.e., increasable and/or decreasable. The predetermined final warning threshold output voltage value can be increased or decreased continuously, by adaptive steps, or by fixed steps, e.g., with step sizes of 0.001 V, 0.002 V, 0.005 V, 0.01 V, 0.02 V, or 0.05 V. The adjustment of the predetermined final warning threshold output voltage value can be performed manually by the user or in dependence of, e.g., a duration between the current output voltage value crossing the predetermined final warning threshold output voltage value and the power source running out of energy. The predetermined final warning threshold output voltage value can be equal to or below 1.15 V, such as equal to or below 1.125 V, such as equal to or below 1.10 V, such as equal to or below 1.05 V. In an embodiment, predetermined final warning threshold output voltage value is in the range from 0.9 V to 1.1 V. In an embodiment, predetermined final warning threshold output voltage value can be varied in steps as small as 0.01 V.

In one embodiment the control unit is configured to increase the predetermined (low energy) threshold output voltage value if a duration between the current output voltage value crossing the predetermined threshold output voltage value and the current output voltage value crossing the predetermined final warning threshold output voltage value is below a predetermined short warning duration. The control unit can be configured to decrease the predetermined threshold output voltage value if a duration between the current output voltage value crossing the predetermined threshold output voltage value and the current output voltage value crossing the predetermined final warning threshold output voltage value is above a predetermined long warning duration.

In one embodiment the hearing device is a hearing aid device. The hearing aid device can further comprise at least a microphone and electric circuitry. The microphone can be configured to receive sound and to generate electrical sound signals representing the sound. The electric circuitry can be configured to process the electrical sound signals. The processing of the electrical sound signals can for example include spectral filtering, frequency dependent amplifying, filtering, or other typical processing of electrical sound signals in a hearing aid device. The hearing aid device can also comprise a telecoil or other wireless technology, e.g., a Bluetooth transceiver, or the like, to receive wireless sound signals. The wireless sound signals can be processed by the electric circuitry. The output transducer can generate processed electrical sound signals representing the sound received by the microphone and/or the wireless sound signals received by the telecoil or other wireless technology. In some hearing aid devices, the output unit comprises an output transducer, such as e.g. a loudspeaker for providing an air-borne acoustic signal or a vibrator for providing a structure-borne or liquid-borne acoustic signal. In some hearing aid devices, the output unit comprises one or more output electrodes for providing electric signals. In an embodiment, the hearing aid device comprises an air conduction hearing aid device, a bone conducting hearing aid device, or a fully or partially implanted hearing aid device, such as a cochlear implant hearing aid device.

The power source can be a battery, an accumulator, a rechargeable battery pack, or the like. The power source can have an initial output voltage in the range of 1 V to 5 V, such as between 1.2 V and 3 V, such as between 1.35 V and 1.65 V.

The control unit can be configured to adjust the predetermined threshold output voltage value to a value such that the duration of the low-energy warning mode is equal to or below 4 h, such as equal to or below 2 h, such as equal to or below 1 h, such as equal to or below 30 minutes. The duration of the low-energy warning mode can be manually selected by the user or the duration can be predetermined.

In one embodiment the control unit operating in the low-energy warning mode is configured to generate electrical low-energy warning signals in periodic time intervals. The time intervals can for example be in the range from 10 minutes to 180 minutes, e.g. 15 minutes, 30 minutes, 1 h, or 2 h. The low-energy warning signals can be equal, change with the interval, or change over time (e.g. decrease with time). The low-energy warning signals can for example increase in intensity, e.g., sound pressure level, over time. The electrical low-energy warning signals can be electrical sound signals, which can be used by the output transducer to generate output sounds. The low energy-warning signals can for example be predetermined sounds, e.g., a tune, a beep, a voice informing the user about the approximate time when the power source is expected to run out of energy, or similar sounds indicative of a low-energy warning. The control unit of a hearing device can be configured to generate electrical low-energy warning signals only when sounds received by the microphone have a sound pressure level, frequency and/or signal-to-noise ratio below a predetermined threshold value. The generation of the low-energy warning signal can be postponed by the control unit until the microphone does not receive a sound with a sound pressure level, frequency and/or signal-to-noise ratio above the predetermined threshold value or until the current output voltage value crosses a predetermined final warning threshold output voltage value. The control unit of the hearing device can also be configured to postpone the generation of the low-energy warning signal under certain circumstances, e.g., when the hearing device emits a sound with a marking feature preventing low-energy warning signals to be generated, when the user has manually deactivated the low-energy warning mode, or under other obvious circumstances. The low-energy warning signals can also be data signals comprising information which can be displayed on a display of the hearing device or on a display of an external (auxiliary) device (e.g. a remote control device, e.g. a SmartPhone) connected to the hearing device.

In one embodiment the hearing device comprises a user interface (e.g. in a remote control device). The user interface can be configured to receive an input by a user. The user interface can for example be a switch, a touch sensitive display, or any other interface configured to interact with a user. The user interface can be used to insert commands to the hearing device, e.g., changing parameters like the predetermined (low energy) threshold output voltage value, the predetermined final warning threshold output voltage value, an approximate predetermined duration of the low-energy warning mode, or other parameters. The change of the parameters can be performed in steps or continuously. The approximate predetermined duration of the low-energy warning mode can be adjusted by the user and the control unit is configured to adjust the predetermined threshold output voltage value and/or the predetermined final warning threshold output voltage value correspondingly to achieve the approximate predetermined duration of the low-energy warning mode. The control unit can be configured to process the input by the user by deactivating the low-energy warning mode. The control unit can also be configured to deactivate the low-energy warning mode only after at least one low-energy warning signal has been generated by the control unit.

The hearing device can activate a low-energy consumption mode, which reduces the energy consumption of the hearing device. The low-energy consumption mode can be automatically activated when the low-energy warning mode is activated and run in parallel to the low-energy warning mode. The low-energy consumption mode can also be activated manually by the user. The low-energy consumption mode can reduce the energy consumption of the hearing device for example by reducing the amplification or the sound pressure level, reducing the amplification or sound pressure level of certain frequencies, e.g., low frequencies or deactivating certain modes of operation, e.g., wireless connection to other devices, or by other energy saving features.

In a further aspect, a hearing system comprising a hearing device as described above, in the 'detailed description of embodiments', and in the claims, AND an auxiliary device is moreover provided. In an embodiment, the system is adapted to establish a communication link between the hearing device and the auxiliary device to provide that information (e.g. control and status signals, possibly audio signals) can be exchanged or forwarded from one to the other. In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme). In an embodiment, the auxiliary device is another hearing device. In an embodiment, the hearing system comprises two hearing devices adapted to implement a binaural hearing system, e.g. a binaural hearing aid system.

In the present context, a SmartPhone, may comprise a cellular telephone comprising a microphone, a speaker, and a (wireless) interface to the public switched telephone network (PSTN) COMBINED with a personal computer comprising a processor, a memory, an operative system (OS), a user interface (e.g. a keyboard and display, e.g. integrated in a touch sensitive display) and a wireless data interface (including a Web-browser), allowing a user to download and execute application programs (APPS) implementing specific functional features (e.g. displaying information retrieved from the Internet, remotely controlling another device, combining information from various sensors of the smartphone (e.g. camera, scanner, GPS, microphone, etc.) and/or external sensors to provide special features, etc.).

The invention further resides in a method for determining a predetermined threshold output voltage value indicative for an activation of a low-energy warning mode. The method can comprise a step of initializing the method with a predetermined threshold output voltage value corresponding to a value of a predetermined warning level counter. The method can comprise a step of determining a current output voltage value. The method can comprise a step of activating a low-energy warning mode in which low-energy warning signals are emitted and starting a timer, if the current output voltage value is below the predetermined threshold output voltage value. The method can comprise a step of increasing the value of the predetermined warning level counter if a duration of the low-energy warning mode is below a predetermined short warning duration. The method can comprise a step of decreasing the value of the predetermined warning level counter if the duration of the low-energy warning mode is above a predetermined long warning duration. The predetermined short warning duration can have a shorter duration than the predetermined long warning duration.

It is intended that some or all of the structural features of the hearing device described above, in the 'detailed description of embodiments' or in the claims can be combined with embodiments of the method, when appropriately substituted by a corresponding process and vice versa. Embodiments of the method have the same advantages as the corresponding devices.

The initial predetermined warning level counter can be set to a lowest value, corresponding to a lowest predetermined threshold output voltage value. The lowest predetermined threshold output voltage value can be high enough to allow operation of a hearing device for a short duration before a power source of the hearing device is completely depleted. The predetermined warning level counter can have a defined number of warning levels, e.g., three, for example low, middle, and high. The predetermined warning levels can correspond to a predetermined threshold output voltage value, e.g., with low corresponding to 1.1 V, with middle corresponding to 1.125 V, and with high corresponding to 1.15 V.

The predetermined short warning duration and predetermined long warning duration can be equal to the predetermined short warning duration and predetermined long warning duration used in the hearing device.

In one embodiment of the method the low-energy warning signals are emitted in periodic time intervals.

One embodiment of the method comprises a step of deactivating the low-energy warning mode when the method is temporarily stopped, e.g., when a hearing device performing the method is turned off. The low-energy warning mode can be re-activated with unchanged parameters, i.e., especially unchanged timer, when the hearing device performing the method is turned on again.

In one embodiment the hearing device is configured to use the method for determining a predetermined threshold output voltage value indicative for an activation of a low-energy warning mode. The predetermined threshold output voltage value is used by the hearing device to activate the low-energy warning mode. The method for determining a predetermined threshold output voltage value can be used in subsequent uses of the hearing device to determine a predetermined threshold output voltage value specific to the user in an iterative way using the method with the hearing device. The predetermined threshold output voltage value can converge to a certain value or change, when parameters of the use scenario, e.g., user, power source type, hearing device parameters, or other parameters, change.

The present invention will be more fully understood from the following detailed description of embodiments thereof, taken together with the drawings in which.

Figure 1:
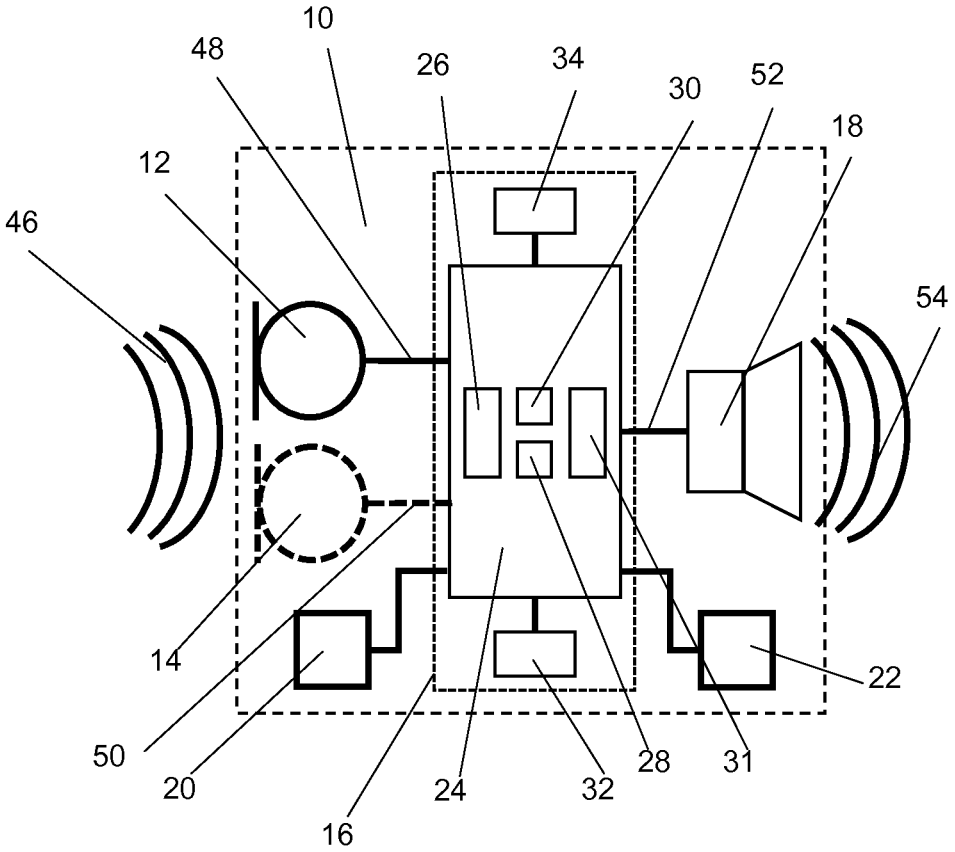
FIG. 1 shows a schematic illustration of an embodiment of a hearing aid.

FIG. 1 shows an embodiment of a hearing aid 10 with a microphone 12, a telecoil (or other wireless receiver) 14, electric circuitry 16, and output unit (here a speaker) 18, a user interface 20 and a battery 22. In another embodiment the telecoil 14 can also be a second microphone, or a Bluetooth-Receiver, Infrared-Receiver, or any other wireless sound signal input configured to receive electrical sound signals wirelessly (not shown). In another embodiment the speaker 18 can also be a bone vibrator of a bone anchored hearing aid or an array of electrodes of a cochlear implant (not shown). In another embodiment, the output unit comprises (e.g. instead of or in addition to the speaker) a transmitter for transmitting signals representative of output sounds (e.g. coded signals) and/or signals indicating low energy warning signals (e.g. to be presented at another device, e.g. to alert a parent or other caretaker).

The electric circuitry 16 comprises a control unit 24, a processing unit 26, a power source charge state monitoring unit 28, a memory 30, a timing unit 31, a receiver unit 32, and a transmitter unit 34. In the present embodiment the processing unit 26, the power source charge state monitoring unit 28, the memory 30, and the timing unit 31 are part of the control unit 24. The hearing aid 10 is configured to be worn at an ear of a user. One hearing aid 10 can for example be arranged at a left ear 36 and one hearing aid 10' can be arranged at a right ear 38 of the user (see FIG. 2) with an insertion part 40 of the hearing aid 10 being arranged in an ear canal 42 of the user.

The hearing aid 10 can be operated in various modes of operation, which are executed by the control unit 24 and use various components of the hearing aid 10. The control unit 24 is therefore configured to execute algorithms, to apply outputs on electrical signals processed by the control unit 24, and to perform calculations, e.g., for filtering, for amplification, for signal processing, or for other functions performed by the control unit 24 or its components. The calculations performed by the control unit 24 are performed in the processing unit 26. Executing the modes of operation includes the interaction of various components of the hearing aid 10, which are controlled by algorithms executed on the control unit 24.

In a hearing aid mode the hearing aid 10 is used as a hearing aid for hearing improvement by sound amplification and filtering. In a low-energy warning mode the hearing aid 10 is used to determine the charge state of the battery 22 and approximate time when the energy of the battery 22 will be depleted (see FIGS. 3 and 4). In a low-energy consumption mode the hearing aid 10 is used in a mode similar to the hearing aid mode, which, in contrast to only improving hearing further reduces the signal quality and sound pressure level of a low frequency range to reduce the energy consumption.

The mode of operation of the hearing aid 10 can be manually selected by the user via the user interface 20 or automatically selected by the control unit 24, e.g., by receiving transmissions from an external device via the receiver unit 32, obtaining a low-energy indication, receiving environment sound, receiving wireless sound signals or other indications that allow to determine that the user is in need of a specific mode of operation. The hearing aid 10 can also execute two or more modes of operation in parallel, e.g., the hearing aid mode and the low-energy warning mode, the low-energy warning mode and the low-energy consumption mode, or any other combination of two or more modes of operation.

The hearing aid 10 operating in the hearing aid mode receives environment sound 46 with the microphone 12 and wireless sound signals with the telecoil 14. The microphone 12 generates electrical environment sound signals 48 representing the environment sound 46 and the telecoil 14 generates electrical wireless sound signals 50 representing the wireless sound signals, which are provided to the control unit 24. If both electrical sound signals 48 and 50 are present in the control unit 24 at the same time, the control unit 24 can decide to process one or both of the electrical sound signals 48 and 50, e.g., as a linear combination or in dependence of the signal-to-noise ratio of the electrical sound signals 48 and 50. The processing unit 26 of the control unit 24 processes the electrical sound signals 48 and 50, e.g., by spectral filtering, frequency dependent amplifying, filtering, or other typical processing of electrical sound signals in a hearing aid generating an output sound signal 52. The processing of the electrical sound signals 48 and 50 by the processing unit 26 depends on various parameters, e.g., sound environment, sound source location, signal-to-noise ratio of incoming sound, user specific hearing ability, mode of operation, type of output transducer, battery charge state, and/or other user specific parameters and/or environment specific parameters. The output sound signal 52 is provided to the speaker 18, which generates an output sound 54 corresponding to the output sound signal 52 which stimulates the hearing of the user.

The hearing aid 10 is powered by the battery 22 (see FIG. 1). The battery 22 has an initial output voltage between 1.35 V and 1.65 V. The initial output voltage can also be below 7 V, e.g. in the range of 1 V to 5 V, such as between 1.2 V and 3 V.

The embodiment of the hearing aid 10 presented in FIG. 1 automatically activates the low-energy warning mode, when a current output voltage value 64, 64' determined by the power source charge state monitoring unit 28 is below a predetermined threshold output voltage value 66, 66' indicative of low-energy of the battery 22 (see FIG. 4). The low-energy warning mode can also be activated manually by the user. The predetermined threshold output voltage value can be equal to or above 1.05 V (68, 68' in FIG. 4), such as equal to or above 1.10 V (66, 66' in FIG. 4), such as equal to or above 1.125 V (70, 70' in FIG. 4), such as equal to or above 1.15 V (72, 72' in FIG. 4). The predetermined threshold output voltage value in FIG. 4 has an initial predetermined threshold output voltage value 66, 66' of 1.10 V. In the embodiment of the hearing aid 10 presented in FIG. 1 the predetermined threshold output voltage value used by the low-energy warning mode is determined by the low-energy warning mode starting with the initial predetermined threshold output voltage value 66, 66' in the first use of the hearing aid 10. The predetermined threshold output voltage value can be increased or decreased continuously, by adaptive steps, or by fixed steps, e.g., with step sizes of 0.001 V, 0.002 V, 0.005 V, 0.01 V, 0.02 V, or 0.05 V by the low-energy warning mode or manually by the user. In every subsequent use after the first use the predetermined threshold output voltage value of the previous use of the hearing aid 10 is used. The hearing aid 10 can also use a predetermined threshold output voltage value stored in the memory 30, e.g., manually selected by the user or automatically selected by the control unit 24 based on parameters, e.g. initial battery capacity, battery type, battery brand, user specific parameters loaded by the user, or the like, determined when the hearing aid 10 is switched in an on state.

The hearing aid 10 operating in the low-energy warning mode causes the timing unit 31 to start a timer and the control unit 24 to generate electrical low-energy warning signals, when the low-energy warning mode is activated due to the current output voltage value 64, 64' crossing the predetermined threshold output voltage value.

The control unit 24 operating in the low-energy warning mode generates electrical low-energy warning signals in periodic time intervals. The control unit 24 can also generate electrical low-energy warning signals only at predetermined durations of the low-energy warning mode or when predetermined warning threshold output voltage values are crossed by the current output voltage value 64, 64'. In the present embodiment the periodic time interval is 15 minutes. The periodic time intervals can for example also be 30 minutes, 1 h, or 2 h. The low-energy warning signals in the present embodiment are electrical sound signals representing bursts of sound with a predefined sound pressure level. The electrical sound signals are provided to the speaker 18 which generates an output sound 54 corresponding to the low-energy warning signal. The low-energy warning signals can also change with the interval or change over time. The low-energy warning signals can for example increase in intensity, e.g., sound pressure level, over time. The low energy-warning signals can also be other predetermined sounds, e.g., a tune, a beep, a voice informing the user about the approximate time when the power source is expected to run out of energy, or other sounds that can be understood as a low-energy warning by the user. The low-energy warning signals are e.g. stored in the memory 30 and can also or alternatively be received by the receiver unit 32 from an external device. The low-energy warning signals can also be data signals comprising information which can be displayed on a display of the hearing aid 10 (not shown) or on a display of an external device, e.g., a mobile phone, a personal computer, tablet computer, or the like, connected to the hearing aid 10 via the receiver unit 32 and the transmitter unit 34. The data signals transmitted to the external device can for example comprise an order for new batteries or a reminder to recharge batteries, which can be used by a third person or an appliance. This allows a third person caring for an impaired person using a hearing aid to receive the low-energy warning signals on the third persons external device and prepare for a replacement or recharging of the battery 22.

The timing unit 31 operating in the low-energy warning mode provides a duration determined from the timer between the activation of the low-energy warning mode and the current point of time to the control unit 24. The timing unit 31 can also provide the duration to the control unit 24 in periodic intervals or provide an activation signal to the control unit 24 after predetermined durations. The control unit 24 in response to the activation signal performs an action, e.g., generates a low-energy warning signal, activates/deactivates a mode of operation or performs another type of action. In the present embodiment of the hearing aid 10 the timer of the timing unit 31 determining the duration of the low-energy warning mode stops when the hearing aid 10 is turned off. In an embodiment, the timer of the timing unit 31 can also measure the time when the hearing aid 10 is offline. The timing unit 31 can provide an offline and online time to the control unit 24. The control unit 24 can discount the offline time, when determining a duration of the low-energy warning mode, e.g., multiplying the offline time with a factor before adding online time and offline time of the hearing aid 10 in low-energy warning mode to determine the duration of the low-energy warning mode. When the hearing aid 10 is reactivated and the power source charge state monitoring unit 28 determines a current output voltage value below the predetermined threshold output voltage value, the timer of the timing unit 31 continues running. If the power source charge state monitoring unit 28 determines a current output voltage value above the predetermined threshold output voltage value, indicating a replaced or recharged battery 22, when the hearing aid 10 is reactivated, the duration of the low-energy warning mode is provided to the control unit 24 and the timer of the timing unit 31 is reset. The control unit 24 uses the duration of the low-energy warning mode to determine a new predetermined threshold output voltage value.

In an alternative embodiment the low-energy warning mode executed on the control unit 24 of the hearing aid 10 stops, when the power source charge state monitoring unit 28 determines a current output voltage value below a predetermined final warning threshold output voltage value 68, 68' (see FIG. 4). The timing unit 31 operating in the low-energy warning mode stops, when the low-energy warning mode is stopped and provides the duration of the low-energy warning mode determined by the timer to the control unit 24. The control unit 24 uses the duration of the low-energy warning mode to determine a new predetermined threshold output voltage value.

The control unit 24 executing the low-energy warning mode determines a new predetermined threshold output voltage value using the duration of the low-energy warning mode, when the low-energy warning mode is stopped. In the present embodiment the predetermined threshold output voltage value can have one of three different values proportional with output voltage, a high predetermined threshold output voltage value 72, 72' with 1.15 V, a middle predetermined threshold output voltage value 70, 70' with 1.125 V, or a low predetermined threshold output voltage value 66, 66' with 1.10 V (see FIG. 4). The predetermined threshold output voltage value can also be any other value between the initial output voltage value of the battery 22 and a final output voltage value of the battery 22 which leads to break down of the battery (i.e. to exhibit a substantial drop in output voltage over a short time, prohibiting electronic circuitry of the hearing aid to function properly). The initial predetermined threshold output voltage value 66, 66' is 1.10 V in the present embodiment of FIG. 4, because a too low initial predetermined threshold output voltage value is more easily corrected. A too high predetermined threshold output voltage value, which results in a long duration of the low-energy warning mode, would need many hours of low-energy warning mode to be corrected. The predetermined final warning threshold output voltage value 68, 68' that stops the low-energy warning mode in the alternative embodiment is 1.05 V (see FIG. 4). The predetermined threshold output voltage value is selected in dependence of the duration of the low-energy warning mode. If the duration of the low-energy warning mode is below 30 minutes, a higher predetermined output voltage value is selected and if the duration of the low-energy warning mode is above 4 h, a lower predetermined output voltage value is selected by the control unit 24. The selection of the predetermined output voltage value can be stepwise, e.g., from middle to high, or from 1.10 V to 1.101 V, etc. in steps of 0.001 V, or can depend on a function, e.g., an increase or decrease of output voltage value defined by a function in dependence of the duration of the low-energy warning mode, such as each minute below 30 minutes leading to an increase of 0.001 V and each minute above 4 h leading to a decrease of 0.001 V, or the like. The predetermined output voltage value selected by the control unit 24 is provided to the memory 30, which stores the value for a subsequent use of the low-energy warning mode of the hearing aid 10 (e.g. after a power-down, and a subsequent power-up of the hearing aid).

The memory 30 is used to store data, e.g., user specific hearing aid usage parameters, predetermined threshold output voltage values, predetermined final warning threshold output voltage values, predetermined output sounds, predetermined electrical sound signals, predetermined time delays, user specific audiograms, algorithms, operation mode instructions, or other data, e.g., used for the processing of electrical sound signals or operating the hearing aid 10.

The receiver unit 32 and transmitter unit 34 (one or both e.g. wireless or one or both e.g. wired) allow the hearing aid 10 to connect to one or more external devices, e.g., a second hearing aid 10' (see FIG. 2), a mobile phone, an alarm, a personal computer, a tablet computer, or other devices. The receiver unit 32 and transmitter unit 34 receive and/or transmit, i.e., exchange, data with the external devices. The hearing aid 10 can for example exchange user specific hearing aid usage parameters, predetermined threshold output voltage values, predetermined final warning threshold output voltage values, low-energy warning signals, predetermined output sounds, predetermined electrical sound signals, predetermined time delays, user specific audiograms, algorithms, operation mode instructions, or other data used, e.g., for operating the hearing aid 10. The receiver unit 32 and transmitter unit 34 can also be combined in a transceiver unit, e.g., a Blue-tooth-transceiver, a wireless transceiver, or the like. The receiver unit 32 and transmitter unit 34 can also be connected with a connector for a wire, a connector for a cable or a connector for a similar line to connect an external device to the hearing aid 10. The battery 22 can be wirelessly recharged, or recharged using a wire or cable connected to the connector for a wire or cable of the hearing aid 10 (not shown).

Figure 2:
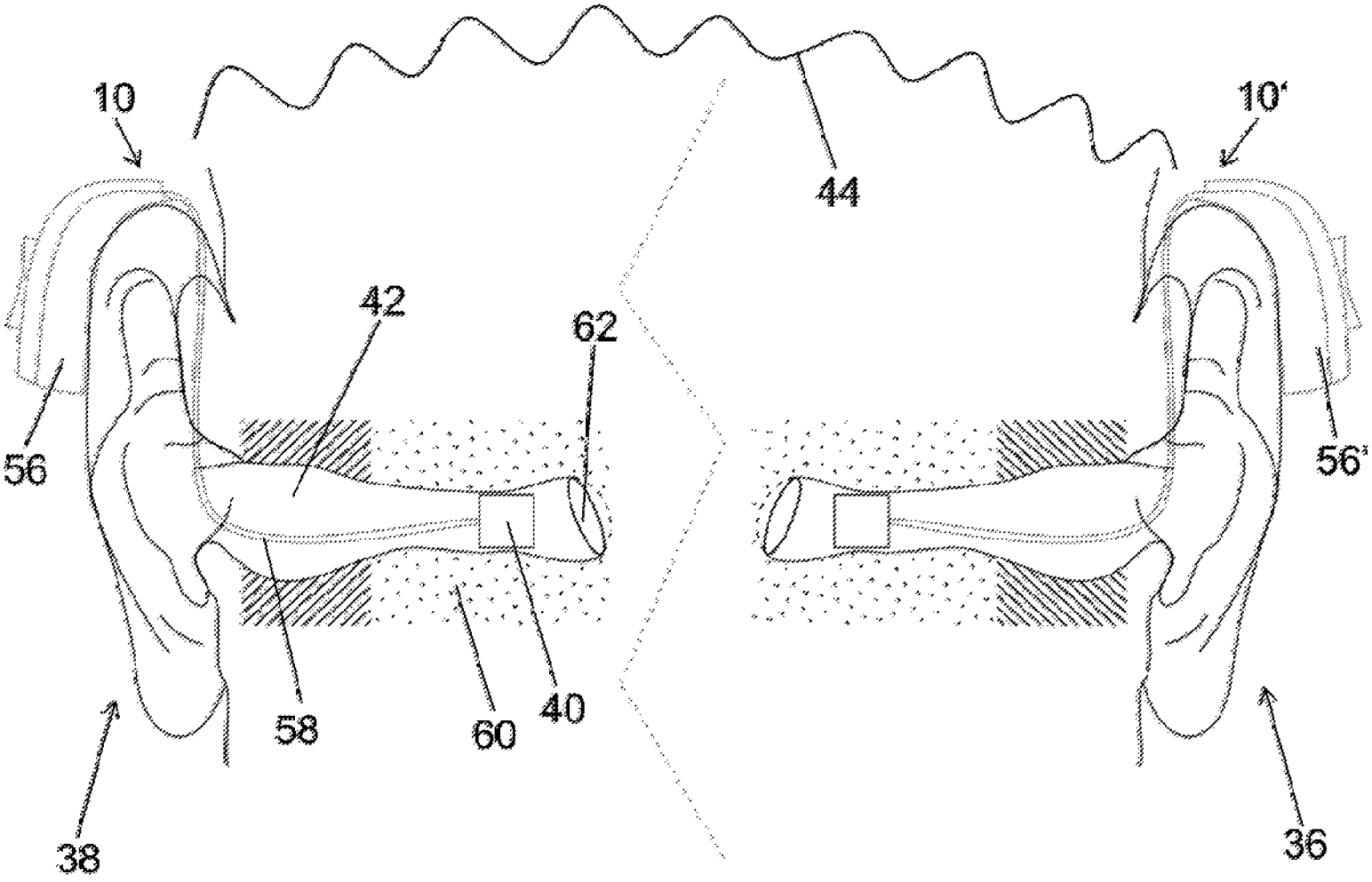
FIG. 2 shows a schematic illustration of an embodiment of a binaural hearing aid device worn at a left ear and at a right ear of a user.

FIG. 2 shows an embodiment of a binaural hearing aid system comprising first and second hearing aids 10 and 10' each with a Behind-The-Ear (BTE) unit 56 and 56' connected via a wireless connection 44. One BTE-unit 56 is mounted behind the right ear 38 and one BTE-unit 56' is mounted behind the left ear 36 of a user. Each of the BTE units comprises the microphone 12, the telecoil 14, the electric circuitry 16, the user interface 20, and the battery 22 (cf. FIG. 1). The speaker 18 is arranged in the insertion part 40, which is connected to the BTE-unit 56 via the lead 58. The insertion part 40 is e.g. arranged fully or partially in a bony portion 60 of the ear canal 42 of the user close to an ear drum 62. The insertion part 40 adheres to a skin portion of the bony portion 60 of the ear canal 42 to close and seal the ear canal 42, which prevents the escape and intrusion of sound. Output sound 54 generated by the speaker 18 stimulates the ear drum 62 which allows auditory perception for the user. Alternatively, the speaker 18 can be arranged further away from the ear drum in a more soft part of the ear canal 42.

Hearing aid 10 and hearing aid 10' each comprise a receiver unit 32 and a transmitter unit 34. The combination of receiver unit 32 and transmitter unit 34 can be used to connect the hearing aid 10 with other devices, e.g., with the hearing device 10' for binaural operation of the hearing aids 10 and 10'. If the hearing aids 10 and 10' are operated binaurally the two hearing aids 10 and 10' are connected with each other wirelessly. The transmitter unit 34 of the hearing aid 10 transmits data to the hearing aid 10' and the receiver unit 32 of the hearing aid 10 receives data from the hearing aid 10', and vice versa. The hearing aids 10 and 10' can exchange data, e.g., user specific hearing aid usage parameters, electrical sound signals 48 and 50, output sound signals 52, predetermined threshold output voltage values, predetermined final warning threshold output voltage values, current output voltage values, data signals, user specific audiograms, or other data, via the wireless connection 44. Additionally or alternatively, the transceiver units 32, 34 (or separate dedicated transceiver units) may be configured to exchange some or all the mentioned data with one or more auxiliary devices, e.g. a remote control unit, e.g. a SmartPhone. In an embodiment, the binaural hearing aid system is configured to exchange data between the two hearing aid devices 10, 10' via an inductive link. In an embodiment, the binaural hearing aid system is configured to exchange data between the two hearing aid devices 10, 10' and an auxiliary device via link based on radiated fields (e.g. according to Bluetooth or similar specification).

Figure 3:
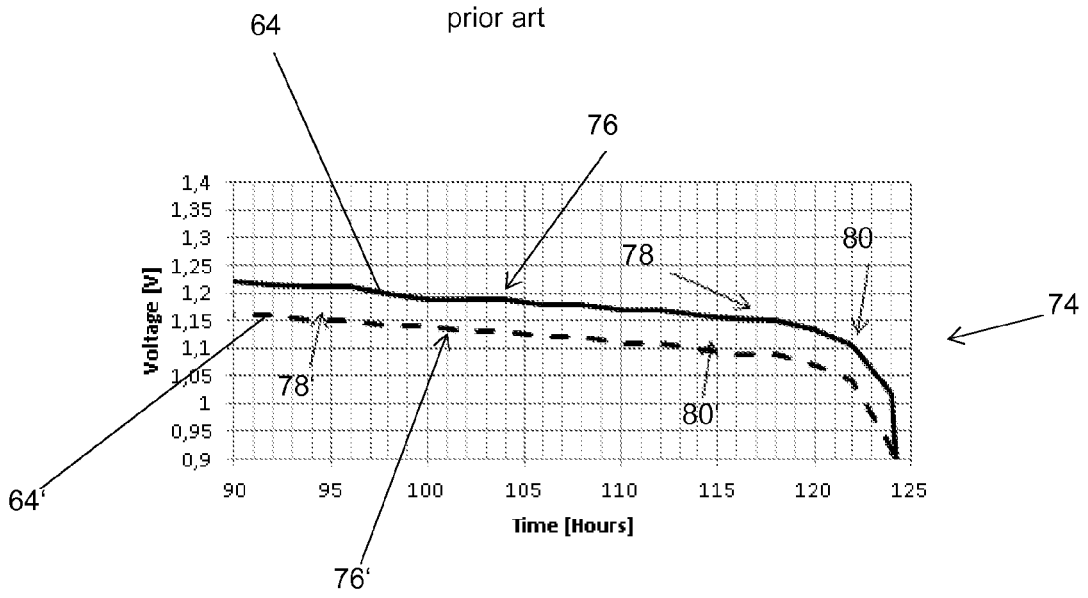
FIG. 3 shows two exemplary discharge curves corresponding to two different hearing aid use scenarios for an identical battery type with prior art low-energy warning.

FIG. 3 shows a discharge curve graph 74 of the battery 22 of the hearing aid 10 with two exemplary discharge curves 76, 76' for the same battery types but with two different use scenarios, meaning different current draws. The discharge curve graph 74 shows the current output voltage 64, 64' of the respective discharge curve 76 (low current draw), 76' (high current draw) plotted against the time of use of the hearing aid 10. The current output voltage 64, 64' decreases due to the increase of internal resistance in the battery 22. The low-energy warning mode presented in FIG. 3 corresponds to a low-energy warning mode of the prior art. The low-energy warning mode is activated when a predetermined pre-warning threshold output voltage value 78, 78' is reached. In the low-energy warning mode of the embodiment of FIG. 3 a low-energy warning signal is generated every 15 minutes and presented to the user. The low-energy warning mode runs until a predetermined final-warning threshold output voltage 80, 80' is reached.

The duration of the low-energy warning mode mainly depends on the use scenario and battery type as the battery discharge curve 76, 76' is easily influenced by the current draw. The hearing aid 10 corresponding to the solid discharge curve 76 (low current draw) has a duration of 5 hours of the low-energy warning mode, while the hearing aid corresponding to the dashed discharge curve 76' (higher current draw) has a duration of 20 hours of low-energy warning mode. The duration is determined as the duration between the current output voltage value 64, 64' crossing the predetermined pre-warning threshold output voltage value 78, 78' and the current output voltage value 64, 64' crossing the predetermined final-warning threshold output voltage value 80, 80'. The target duration is around 2 hours. Some users have reported the duration of the low-energy warning mode to last up to 4 days, while other users experienced a very short duration of low-energy warning mode of only a few minutes.

Figure 4:
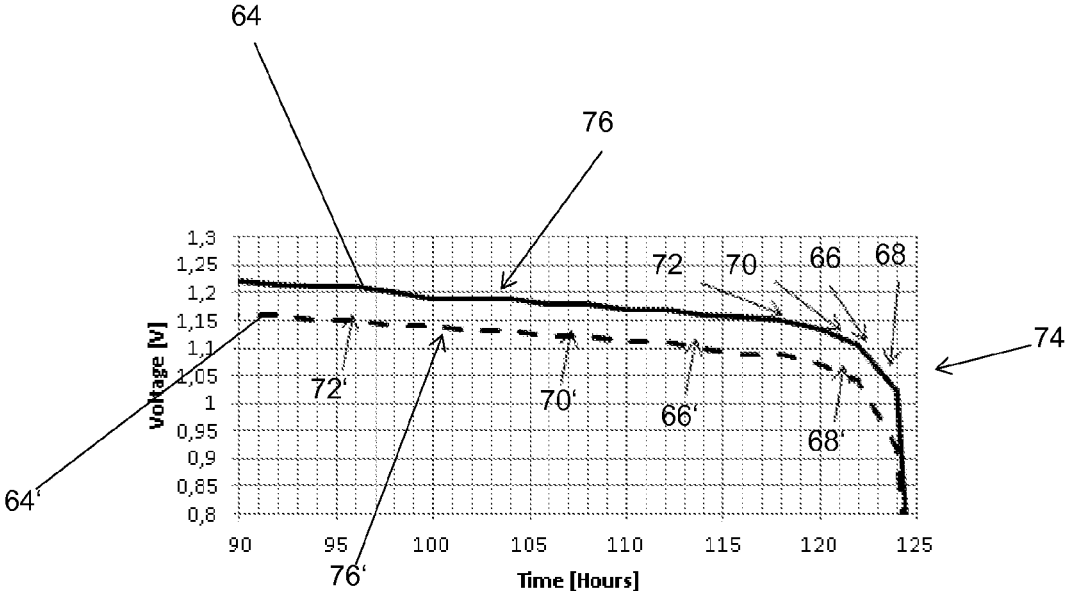
FIG. 4 shows two exemplary discharge curves corresponding to two different hearing aid use scenarios for an identical battery type with use scenario specific low-energy warnings.

FIG. 4 shows the discharge curve graph 74 of the battery 22 of the hearing aid 10 with the two exemplary discharge curves 76, 76' for the same battery types but with two different use scenarios, meaning different current draws.

In contrast to the embodiment of the low-energy warning mode of the prior art presented in FIG. 3, the embodiment of the low-energy warning mode presented in FIG. 4 has a dynamic pre-warning correction (DPC), meaning, that the predetermined threshold output voltage value is adjusted by the low-energy warning mode in order to find a predetermined threshold output voltage value that is suitable for the current user. Adjusting the predetermined threshold output voltage value allows to adjust the duration of the low-energy warning mode, e.g., which allows to adjust the duration to the target duration of for example 2 h.

The energy consumption, i.e., current consumption, of a hearing device depends on the choice of device, user specific hearing loss and user activity. The battery discharge curve 76, 76' depends on the parameters of the battery 22, e.g., battery capacity, battery type, battery brand, or other battery parameters and energy consumption, i.e., current consumption determined by the use scenario. A typical user tends to use batteries 22 in subsequent uses of a hearing device, e.g., hearing aid 10, with identical parameters and typically has a user specific use scenario that does not differ significantly over the use cycle of the hearing device, i.e., the user continuously uses the same battery brand and has a steady energy consumption. This leads to a battery discharge curve 76 or 76' specific to a specific user using a specific hearing aid 10 that has the somewhat same properties day after day.

The control unit 24 operating in the low-energy warning mode, i.e., the dynamic pre-warning correction (DPC) feature running on the control unit 24, monitors and analyses the duration of the low-energy warning mode to determine if a current low-energy warning level corresponding to a predetermined threshold output voltage value, e.g., 72, 70, or 66, is suitable for the current user with the discharge curve 76. Another user with the discharge curve 76' might have another suitable predetermined threshold output voltage value, e.g., 72', 70', or 66'. If the predetermined threshold output voltage value is not suitable for the current user, the predetermined threshold output voltage value is increased or decreased by the low-energy warning mode to better fit the user needs. If the predetermined threshold output voltage value is suitable for the current user, meaning that the duration of the low-energy warning mode is in between a favourable duration range, the predetermined threshold output voltage value, i.e., the current low-energy warning level is unchanged. The favourable duration for the low-energy warning mode in the present embodiment is between 30 minutes and 4 h.

The end of the low-energy warning mode can be determined by a user replacing the battery 22, therefore the current output voltage value determined by the power source charge state monitoring unit will be above the predetermined threshold output voltage value and the low-energy warning mode stops. Alternatively, the end of the low-energy warning mode can be determined by the current output voltage value crossing a predetermined final warning threshold output voltage value 68, 68', which then leads to a stop of the low-energy warning mode. Also, both aforementioned constraints can be implemented in the low-energy warning mode, meaning that the low-energy warning mode either stops when the current output voltage value crosses the predetermined final warning threshold output voltage value 68, 68' or when the battery 22 is recharged or replaced earlier. Therefore the user behaviour is taken into account. If the user tends to replace or recharge the battery 22 shortly after the activation of the low-energy warning mode the duration can be reduced to a shorter duration for the low-energy warning mode, e.g., 30 minutes or below. If the user tends to replace or recharge the battery 22 only after a significant duration after the activation of the low-energy warning mode the duration can be increased to a longer duration for the low-energy warning mode, e.g., 4 h or above.

The low-energy warning mode can be easily implemented in prior art systems.

Figure 5:
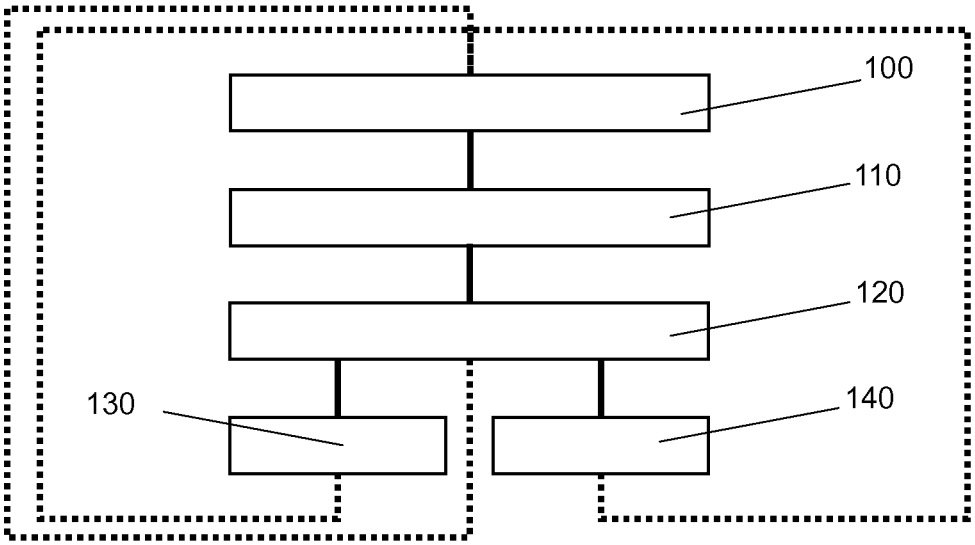
FIG. 5 shows a schematic block diagram with an embodiment of a method to generate use scenario specific low-energy warnings.

FIG. 5 shows a schematic block diagram with an embodiment of a method to generate use scenario specific low-energy warnings by determining a predetermined threshold output voltage value, which is indicative for the activation of the low-energy warning mode. The method comprises the steps:

100 initializing the method with a predetermined threshold output voltage corresponding to a value of a predetermined warning level counter;

110 determining a current output voltage value;

120 if the current output voltage value is below the predetermined threshold output voltage value, activating a low-energy warning mode in which low-energy warning signals are emitted and starting a timer;

130 increasing the value of the predetermined warning level counter if a duration of the low-energy warning mode is below a predetermined short warning duration;

and

140 decreasing the value of the predetermined warning level counter if the duration of the low-energy warning mode is above a predetermined long warning duration.

The predetermined short warning duration has a smaller duration than the predetermined long warning duration. The predetermined short warning duration in the present embodiment of the method is 30 minutes and the predetermined long warning duration is 4 h. The predetermined short warning duration can be equal to or below 120 minutes, such as equal to or below 60 minutes, such as equal to or below 30 minutes. The predetermined long warning duration can be equal to or above 2 h, such as equal to or above 4 h, such as equal to or above 8.5 h. The predetermined short warning duration and predetermined long warning duration can also be adjustable, e.g., by the user of the hearing device. The predetermined short warning duration and predetermined long warning duration can be increased or decreased continuously, by adaptive steps, or by fixed steps, e.g., with step sizes of 1 minute, 10 minutes, 30 minutes, 1 h, 2 h, or 4 h.

REFERENCE SIGNS

10 hearing aid
12 microphone
14 telecoil
16 electric circuitry
18 speaker
20 user interface
22 battery
24 control unit
26 processing unit
28 power source charge state monitoring unit
30 memory
31 timing unit
32 receiver unit
34 transmitter unit
36 left ear
38 right ear
40 insertion part
42 ear canal
44 wireless connection
46 environment sound
48 electrical environment sound signals
50 electrical wireless sound signals
52 output sound signal
54 output sound
56 Behind-The-Ear (BTE) unit
58 lead
60 bony portion

62 ear drum
64 current output voltage
66 low predetermined threshold output voltage value
68 predetermined final-warning threshold output voltage value
70 middle predetermined threshold output voltage value
72 high predetermined threshold output voltage value
74 discharge curve graph
76 discharge curve
78 pre-warning threshold output voltage value
80 predetermined final-warning threshold output voltage value of prior art

The invention claimed is:

1. A hearing device configured to be worn on or at an ear of a user comprising a power source configured to power the hearing device, a control unit, a power source charge state monitoring unit configured to monitor the charge state of the power source by determining a current output voltage value of the power source, a timing unit configured to measure a duration between two points in time, and an output unit configured to generate output stimuli perceived by the user as sound corresponding to electrical sound signals, wherein the control unit is configured to activate a low-energy warning mode, if the current output voltage value determined by the power source charge state monitoring unit is below a predetermined threshold output voltage value of the power source and to adjust the predetermined threshold output voltage value in dependence of a duration of the low-energy warning mode, wherein the control unit operating in the low-energy warning mode is configured to generate electrical low-energy warning signals, wherein the control unit is configured to generate an electrical final warning signal, if the current output voltage value determined by the power source charge state monitoring unit is below a predetermined final warning threshold output voltage value, and wherein the control unit is configured to increase the predetermined threshold output voltage value if a duration between the current output voltage value crossing the predetermined threshold output voltage value and the current output voltage value crossing the predetermined final warning threshold output voltage value is below a predetermined short warning duration, and to decrease the predetermined threshold output voltage value if a duration between the current output voltage value crossing the predetermined threshold output voltage value and the current output voltage value crossing the predetermined final warning threshold output voltage value is above a predetermined long warning duration.

2. A hearing device according to claim 1, wherein the output unit is configured to generate output stimuli corresponding to the electrical low-energy warning signals.

3. A hearing device according to claim 1, wherein the predetermined short warning duration has a smaller duration than the predetermined long warning duration, and the predetermined short warning duration is equal to or below 120 minutes, and the predetermined long warning duration is equal to or above 2 h.

4. A hearing device according to claim 1, wherein the hearing device is a hearing aid, further comprising at least a microphone and electric circuitry, wherein the microphone is configured to receive sound and to generate electrical sound signals representing the sound and wherein the electric circuitry is configured to process the electrical sound signals.

5. A hearing device according to claim 1, wherein the control unit is configured to adjust the predetermined threshold output voltage value to a value such that the duration of the low-energy warning mode is equal to or below 4 h.

6. A hearing device according to claim 1, wherein the electrical low-energy warning signals are electrical sound signals.

7. A hearing device according to claim 1, wherein the hearing device comprises a user interface, wherein the user interface is configured to receive an input by a user and wherein the control unit is configured to process the input by the user by deactivating the low-energy warning mode.

8. A hearing device according to claim 1, wherein the output unit comprises a transmitter for transmitting signals representative of output sounds and/or signals indicating low energy warning signals to an auxiliary device.

9. A hearing system comprising a hearing device according to claim 1 and an auxiliary device, the system being adapted to establish a communication link between the hearing device and the auxiliary device to provide that information can be exchanged or forwarded from one to the other.

10. A hearing system according to claim 9 wherein the auxiliary device comprises an audio gateway, a remote control for controlling functionality and operation of the hearing device or another such hearing device.

11. A hearing system according to claim 9 wherein the auxiliary device comprises a user interface allowing a user to exchange data with the hearing aid device.

12. A hearing system according to claim 9 wherein the auxiliary device comprises a SmartPhone, the SmartPhone being adapted to run an APP allowing to control functionality of the hearing device via the SmartPhone.

13. A method for determining a predetermined threshold output voltage value indicative for an activation of a low-energy warning mode, wherein the method comprises the steps:

initializing the method with a predetermined threshold output voltage value corresponding to a value of a predetermined warning level counter, determining a current output voltage value, if the current output voltage value is below the predetermined threshold output voltage value, activating a low-energy warning mode in which low-energy warning signals are emitted and starting a timer, increasing the value of the predetermined warning level counter if a duration of the low-energy warning mode is below a predetermined short warning duration, and decreasing the value of the predetermined warning level counter if the duration of the low-energy warning mode is above a predetermined long warning duration, wherein the predetermined short warning duration has a smaller duration than the predetermined long warning duration.

14. Use of a hearing device according to claim 1.

15. A data processing system comprising a processor and program code means for causing the processor to perform the steps of the method of claim 13.

* * * * *